US006863862B2

(12) United States Patent
Rasouli et al.

(10) Patent No.: US 6,863,862 B2
(45) Date of Patent: Mar. 8, 2005

(54) METHODS FOR MODIFYING OXYGEN CONTENT OF ATOMIZED INTERMETALLIC ALUMINIDE POWDERS AND FOR FORMING ARTICLES FROM THE MODIFIED POWDERS

(75) Inventors: Firooz Rasouli, Midlothian, VA (US); Clive Scorey, Cheshire, CT (US); John McKernan, Middlebury, CT (US); John F. Cunningham, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 219 days.

(21) Appl. No.: 10/233,478

(22) Filed: Sep. 4, 2002

(65) Prior Publication Data

US 2004/0042922 A1 Mar. 4, 2004

(51) Int. Cl.[7] ..... B22F 1/00; C22C 1/04

(52) U.S. Cl. ..... 419/32; 419/33; 419/38; 75/246

(58) Field of Search ..... 419/32, 33, 38; 75/246

(56) References Cited

U.S. PATENT DOCUMENTS

| | | | | |
|---|---|---|---|---|
| 2,582,993 A | | 1/1952 | Howatt | |
| 2,864,734 A | | 12/1958 | Adams et al. | |
| 2,966,719 A | | 1/1961 | Park | |
| 3,070,426 A | | 12/1962 | Triffleman | |
| 3,097,929 A | | 7/1963 | Ragan | |
| 3,110,091 A | | 11/1963 | Little et al. | |
| 3,206,304 A | | 9/1965 | Bechtold | |
| 3,785,801 A | * | 1/1974 | Benjamin | 75/255 |
| 4,594,217 A | | 6/1986 | Samal | |
| 4,687,678 A | | 8/1987 | Lindblom | |
| 4,701,301 A | | 10/1987 | Kuwahara et al. | |
| 4,999,155 A | | 3/1991 | Ong et al. | |
| 5,160,534 A | * | 11/1992 | Hiraki | 75/248 |
| 5,229,221 A | | 7/1993 | Donado et al. | |
| 5,306,569 A | * | 4/1994 | Hiraki | 428/569 |
| 5,312,582 A | | 5/1994 | Donado | |
| 5,352,522 A | | 10/1994 | Kugimiya et al. | |
| 5,368,657 A | | 11/1994 | Anderson et al. | |
| 5,529,108 A | | 6/1996 | Newkirk et al. | |
| 5,679,297 A | | 10/1997 | Hwang | |
| 5,705,280 A | | 1/1998 | Doty | |
| 5,976,458 A | | 11/1999 | Sikka et al. | |
| 6,030,472 A | | 2/2000 | Hajaligol et al. | |
| 6,409,965 B1 | * | 6/2002 | Nagata et al. | 419/26 |
| 6,660,109 B2 | * | 12/2003 | Hajaligol et al. | 148/651 |

OTHER PUBLICATIONS

B. Lynn Ferguson et al., Powder Shaping and Consolidation Technologies, Deformation Control Technology, Inc. and Pennsylvania State University, pps. 313–314.

(List continued on next page.)

*Primary Examiner*—Daniel Jenkins
(74) *Attorney, Agent, or Firm*—Burns, Doane, Swecker & Mathis, L.L.P.

(57) ABSTRACT

Methods of producing atomized intermetallic aluminide powders with a controlled oxygen content, and articles made from the powders by powder metallurgical techniques are disclosed. Gas atomized intermetallic aluminide powders can be oxidized to increase their oxygen content. Water atomized intermetallic aluminide powders can be milled to change their size, shape and/or oxygen content. Blends or mixtures of modified gas and water atomized intermetallic aluminide powders can be processed into articles by powder metallurgical techniques.

39 Claims, 6 Drawing Sheets

OTHER PUBLICATIONS

M.R. Hajaligol et al., A Thermomechanical Process to Make Iron Aluminide (FeA1) Sheet, Mater. Sci. Eng. A258, 1998, pps. 249–257.

R.E. Mistler et al., Tape Casting as a Fabrication Process for Iron Aluminide (FEA1) Thin Sheets, Mater. Sci. Eng. A258, 1998, pps. 258–265.

Richard E. Mistler, Ceramics and Glasses, Engineered Materials Handbook, vol. 4, 1991, pps. 161–165.

Richard E. Mistler, Tape Casting: the Basic Process for Meeting the Needs of the Electronics Industry, Ceramic Bulletin, vol. 69, No. 6, 1990 (copy to be supplied at a later date).

Richard E. Mistler, Tape Casting: the Basic Process for Meeting the Needs of the Electronics Industry. Ceramic Bulletin, vol. 69, No. 6, 1990.

* cited by examiner

TAPE CASTING FLOW CHART

Sieving Powder

↓

Blending or Mixing Intermetallic Aluminide Powders

↓

Mixing Powder with Binder and Solvent

↓

Tape Casting Powder Green Strip

↓

Burning Out Binder

↓

Primary Sintering

↓

Cold Rolling Strip

↓

Annealing

↓

Trimming Strip

↓

Cold Rolling Strip

↓

Annealing

↓

Trimming to Desired Dimensions

↓

Stress Relieving

↓

Forming Article

FIG. 8

METHODS FOR MODIFYING OXYGEN CONTENT OF ATOMIZED INTERMETALLIC ALUMINIDE POWDERS AND FOR FORMING ARTICLES FROM THE MODIFIED POWDERS

BACKGROUND OF THE INVENTION

1. Field of the Invention

The invention is directed to intermetallic powders. More particularly, methods for modifying atomized intermetallic aluminide powders and powder metallurgical methods for forming articles from the modified powders are provided.

2. Description of Related Art

Metal powders can be fabricated by atomization techniques, which form metal powder from molten metal using a spray of droplets. Elemental and pre-alloyed metal powders can be formed by atomization techniques. Water atomization and gas atomization techniques are commonly used to form these powders.

Water atomization utilizes rapid solidification of molten metal, which produces irregular shaped particles having a rough surface texture. In addition, water atomized powders can have a high oxygen and oxide level. For example, the water atomization of FeAl alloy powders can require special precautions to reduce the oxygen content of the particles and prevent the formation of oxides of iron and aluminum on the surface. Excessive oxidation of such particles can produce stringers of oxides in articles made from the particles. See M. R. Hajaligol, et al., "A Thermomechanical Process to Make Iron Aluminide (FeAl) Sheet," Mater. Sci. Eng. A258 (1998) pp. 249–257. A non-uniform distribution of oxides can cause property variations within articles and also result in article-to-article property variations. See U.S. Pat. No. 6,030,472 to Hajaligol et al., which is hereby incorporated herein by reference in its entirety. In addition, a high surface oxide content reduces bonding between particles during sintering. See R. E. Mistler, et. al., "Tape Casting as a Fabrication Process for Iron Aluminide (FeAl) Thin Sheets," Mater. Sci. Eng. A258 (1998) pp. 258–265.

In contrast, gas atomization techniques utilize gases, such as air, nitrogen or inert gases, as the atomizing fluid and achieve lower cooling rates of molten metal than water atomization techniques. Due to the use of these gases and lower cooling rates, powders produced by gas atomization techniques are more spherical, have less oxidation and surface oxides, and have a higher apparent density, than water atomized powders.

The packing density of atomized powders is related to the particle surface area and particle shape. Water atomized powders have irregular shapes and associated increased surface area. Gas atomized powders are typically smaller in size and more regular shaped than water atomized powders. In general, water atomized powders have a lower packing density than gas atomized powders. A lower packing density can significantly affect the final density and resulting mechanical properties of the material.

The mechanical properties of a metallic alloy can also be affected by the amount and distribution of oxides in the powder particles. Generally, well-distributed oxides can strengthen an alloy. However, oxide stringers can provide undesirable initiation sites for cracks and deleteriously affect mechanical properties of articles. In addition, oxide stringers can negatively affect the sintering performance of articles, resulting in articles having unsatisfactory microstructures and/or properties. Such oxide stringers can thus limit the performance of articles made from water atomized powders.

In contrast, gas atomized powders have a lower oxygen content and thus are less susceptible to oxide stringer problems than water atomized powders. However, due to their low oxygen content, gas atomized powders do not contain well-distributed oxides. Without such well-distributed oxides, the mechanical properties of gas atomized powders can be unsatisfactory for some applications. In addition, gas atomized powders can be unsatisfactory for some powder metallurgical techniques where they provide insufficient particle bonding in the green state.

SUMMARY OF THE INVENTION

Therefore, there is a need for methods of modifying gas atomized and water atomized metal powders that can control the oxygen content of the powders. Preferred embodiments provide methods of modifying gas atomized and water atomized metal powders that can satisfy this need, as well as other needs.

Preferred embodiments provide methods of modifying atomized intermetallic aluminide powders. These methods include modifying gas atomized intermetallic aluminide powders to control their oxygen content. The methods can modify the oxygen content of gas atomized intermetallic aluminide powders to improve their mechanical properties.

Preferred embodiments also provide methods of modifying water atomized intermetallic aluminide powders to control their particle size and shape. These methods can modify the particle size and shape of water atomized intermetallic aluminide powders to improve the powders' packing characteristics. The methods can also modify the oxygen content and/or oxide distribution of water atomized intermetallic aluminide powders. The methods can modify the content and distribution of oxygen, and oxides, in water atomized intermetallic aluminide powders to improve the powders' sintering performance and mechanical properties.

Preferred embodiments also provide methods of making blends (i.e., combinations of two or more powders having the same powder chemistries) or mixtures (i.e., combinations of two or more powders having different powder chemistries) of atomized intermetallic aluminide powders. The powder blends and mixtures can provide a controlled oxygen content and desired particle size and shape characteristics. Embodiments of these methods comprise modifying the average particle size, particle shape and/or oxygen content of a gas atomized intermetallic aluminide powder; and/or modifying the average particle size, particle shape, oxygen content and/or oxide distribution of a water atomized intermetallic aluminide powder; and combining the gas and water atomized powders to form an intermetallic aluminide powder blend or mixture.

Preferred embodiments further provide methods of making intermetallic aluminide articles having a controlled oxide content by a powder metallurgical technique. Embodiments of the methods comprise making an article by a metallurgical technique from a blend or mixture of water atomized and gas atomized intermetallic aluminide powders, where at least one of the powders has been modified with respect to at least one of average particle size, particle shape, oxygen content and oxide distribution. In some preferred embodiments, both the water atomized and gas atomized powders have been modified. In some embodiments, at least one of the water atomized and gas atomized intermetallic aluminide powders is modified before forming the blend or mixture of the powders. In other embodiments, at least one of the water atomized and gas atomized intermetallic aluminide powders is modified during processing, i.e., after forming the blend or mixture of the powders.

In embodiments, the modified intermetallic aluminide powders can be used to form articles by a suitable metallurgical technique. A preferred powder metallurgical technique is tape casting.

BRIEF DESCRIPTION OF THE DRAWING FIGURES

Various features and advantages of preferred embodiments of the invention will become apparent from the following detailed description in connection with the accompanying drawings in which like numerals designate like elements and in which:

FIG. 8 shows a flow chart of processing steps for a tape casting process.

DETAILED DESCRIPTION OF THE PREFERRED EMBODIMENTS

Figure 1:
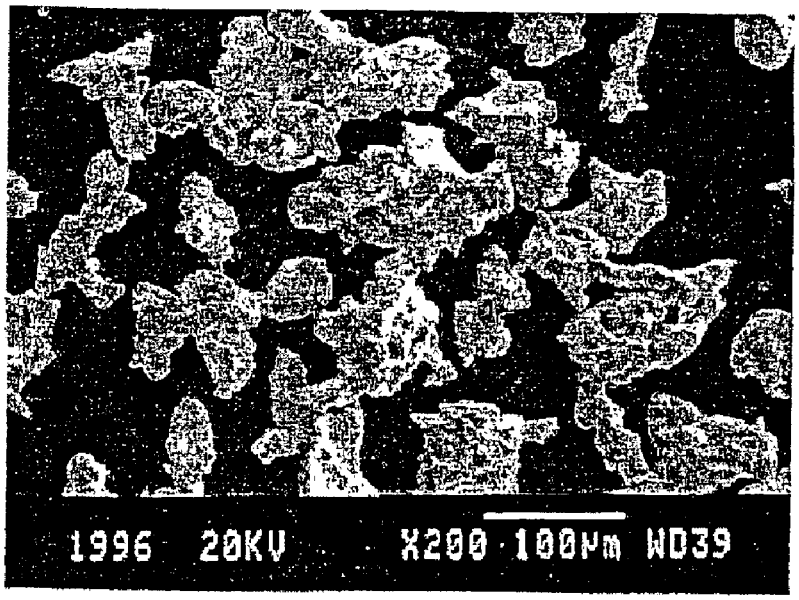
FIG. 1 shows a first water atomized intermetallic iron aluminide powder prior to size reduction.

Methods of modifying atomized intermetallic aluminide powders to improve the properties of articles produced from the modified powders, and/or to improve the sintering performance of the powders, are provided. Methods of making articles using the modified intermetallic aluminide powders are also provided.

In a preferred embodiment atomized intermetallic powders are prepared such that control of the oxygen content of the powders can be achieved. For example, the oxygen content of atomized intermetallic aluminide powders can be increased and/or the distribution of oxides in these powders can be improved by such modification. The modified powders can provide the beneficial effects of having a dispersion of oxides. Consequently, the modified powders can be used in powder metallurgical processes to make articles having improved mechanical properties and other advantages. These methods are advantageous for modifying gas atomized intermetallic aluminide powders, which typically have low oxygen contents and consequently typically lack a sufficient amount and dispersion of oxides.

In another embodiment water atomized intermetallic aluminide powders are prepared such that the size and/or shape of the powders can be controlled. By such modification, the packing characteristics of water atomized intermetallic aluminide powders can be improved. The oxygen content and/or oxide distribution of such powders may be modified to improve their sintering performance, and improve the properties of articles made from the modified powders by powder metallurgical techniques.

Methods of making blends (i.e., combinations of two or more powders having the same powder chemistries) or mixtures (i.e., combinations of two of more powders having different powder chemistries) of atomized intermetallic aluminide powders that have a controlled oxygen content, desirable particle size and/or particle shape characteristics, are also provided. Embodiments of these methods comprise modifying at least one of a gas atomized intermetallic aluminide powder and a water atomized intermetallic aluminide powder, and combining the powders to form a blend or mixture that can provide desired properties and characteristics of both of the powders.

Methods of making intermetallic aluminide articles having a controlled oxide content by powder metallurgical techniques are also provided. Embodiments of these methods comprise modifying the oxygen content, oxygen distribution, particle size and/or particle shape of gas atomized and/or water atomized intermetallic aluminide powders; and forming an article from a blend or mixture of the modified powders by a powder metallurgical technique. Embodiments of the methods can advantageously utilize at least some gas atomized powders in certain metallurgical techniques, such as tape casting, in which gas atomized powders have not previously been successfully used. Thus, such methods can provide increased versatility by increasing powder selection, as well as produce articles that can utilize desirable properties of both gas and water atomized powders.

Modification of Gas Atomized Powders

Gas atomized intermetallic aluminide powders are generally spherical shaped. These powders typically are formed using inert gases as the atomizing fluid and, consequently, have a very low oxygen content. For example, gas atomized powders can typically have an oxygen content of from about 0.05–0.08 wt. %. Due to having such a low oxygen content, gas atomized powders are typically essentially oxide free. As stated above, because gas atomized powders typically contain a low level of oxygen, they lack well-distributed oxides, making the mechanical properties of gas atomized powders unsatisfactory for some applications.

Gas atomized intermetallic aluminide powders can be modified to increase their oxygen content. By increasing the oxygen content of these powders, the oxide content of the powders can be increased as well. Consequently, the mechanical properties of articles manufactured from the modified powders by a powder metallurgical technique can be improved. For example, the yield strength of articles manufactured from the modified gas atomized intermetallic aluminide powders can be increased. In addition, articles manufactured from the modified gas atomized intermetallic aluminide powders using metallurgical techniques can have a smaller average grain size than articles formed from unmodified gas atomized intermetallic aluminide powders.

The oxygen content can be increased by any desired amount, and preferably by at least an amount effective to improve one or more mechanical properties of the powders, such as the yield strength or tensile strength. In addition, by increasing the oxygen content of gas atomized intermetallic aluminide powders, articles can be produced from the modified powders with reduced grain sizes.

Advantageous effects provided by increasing the oxygen content of gas atomized intermetallic aluminide powders can be achieved by even relatively small increases in the total oxygen content of the powders. For example, increasing the total oxygen content of gas atomized intermetallic aluminide powders by as little as about 200 ppm has been found to provide a significant increase in yield strength (from about 38 ksi to about 45 ksi), as well as a significant decrease in the average grain size (from about 30 μm to about 19 μm), of articles produced from the modified gas atomized intermetallic aluminide powders. Accordingly, the composition of gas atomized intermetallic alumininde powders can be modified in a simple manner to provide significant improvements in the mechanical properties of articles manufactured from the modified powders.

In an embodiment, gas atomized intermetallic aluminide powders can be modified in any suitable oxygen containing atmosphere. For example, the powders can be modified in an atmospheric oven or in ovens that are sealed from the atmosphere. In these methods, the gas atomized intermetallic aluminide powders are heated at a sufficiently high temperature and for a sufficient amount of time to increase the oxygen content of the powders by a desired amount. The temperature is preferably at least about 500° C. The oxygen-containing atmosphere preferably has a dew point of no more than about +60° F. Increasing the total oxygen content of gas atomized intermetallic aluminide powders by as little as about 200 ppm can provide a significant improvement in yield strength of sintered articles. The increase in oxygen content of the powders can be determined by measuring the total oxygen content of the modified powders using any suitable oxygen measuring device.

In another embodiment, the oxygen content of gas atomized intermetallic aluminide powders can be modified in an oxygen containing atmosphere before these powders are mixed with other powders, such as water atomized intermetallic aluminide powders, as described below. Alternatively or additionally, in another embodiment the oxygen content of gas atomized intermetallic aluminide powders can be modified in an oxygen containing atmosphere after these powders have been blended or mixed with one or more powders, as also described below.

The gas atomized intermetallic aluminide powders that can be modified include, but are not limited to, Ni-based intermetallic aluminides, Ti-based intermetallic aluminides, Fe-based intermetallic aluminides and mixtures thereof. The intermetallic aluminide powders are preferably iron aluminides containing from about 8 to about 32 wt. % Al.

Modification of Water Atomized Powders

Water atomized intermetallic aluminide powders typically have irregular shapes and rough surface textures. The water spray contacting a liquid metal stream forms the irregular shaped powder, resulting in oxidation of the water atomized powders. The water atomization process typically produces surface oxides.

In an embodiment, water atomized intermetallic aluminide powders can be modified to change their size and/or shape. Particularly, the average particle size can be reduced. The particle shape can be modified to increase surface rounding, i.e., make the surface texture less rough. By these modifications, the modified powders can provide improved packing characteristics, including an increased packing density, as compared to unmodified powders. Consequently, the green density of articles manufactured from the modified water atomized intermetallic aluminide powders can be increased, which increases the degree of sintering. By increasing the degree of sintering, mechanical properties of the sintered articles are improved.

In another embodiment, water atomized intermetallic aluminide powders can be modified by any suitable technique that changes the particle size and/or shape, and modifies the oxide distribution of the powders to make the distribution more uniform throughout the volume of the powders. Preferably, the water atomized powders are modified by a wet milling or dry milling process. Wet milling processes utilize a liquid milling fluid. The liquid milling fluid can be deionized water, an organic solvent, such as acetone, or any other suitable liquid. Dry milling processes (e.g., jet milling) use a dry fluid medium, such as an inert gas. Water atomized intermetallic aluminide powders can be milled by either wet milling or dry milling to achieve a desired average particle size or particle size distribution.

Milling processes affect the oxygen content of water atomized intermetallic aluminide powders. Typically, the oxygen content is increased by a small amount, such as from about 0.02–0.08 wt. %. However, the oxygen content can be increased by a greater amount, such as up to several weight percent, by wet milling processes using water as the milling medium.

The water atomized intermetallic aluminide powders that can be modified include, but are not limited to, Ni-based intermetallic aluminides, Ti-based intermetallic aluminides, Fe-based intermetallic aluminides and mixtures thereof. The intermetallic aluminide powders are preferably iron aluminides containing from about 8 to about 32 wt. % Al.

Figure 2:
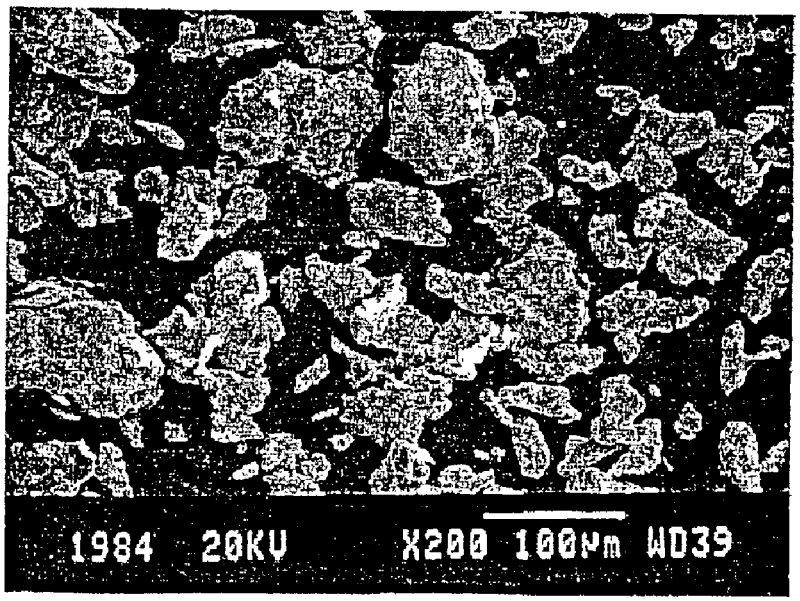
FIG. 2 shows the first water atomized intermetallic iron aluminide powder of FIG. 1 following wet milling.
Figure 3:
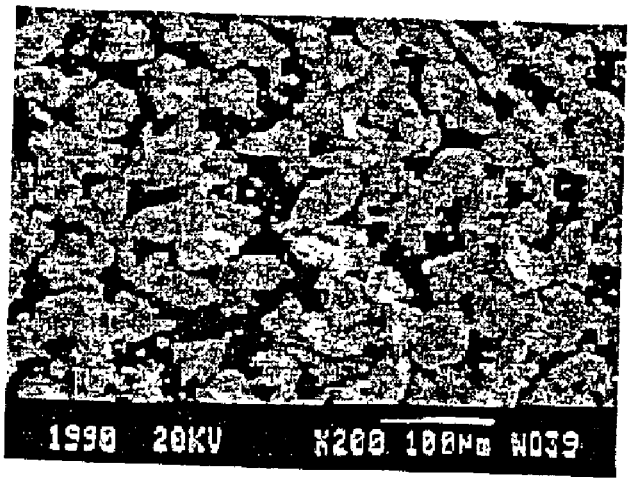
FIG. 3 shows a second water atomized intermetallic iron aluminide powder prior to size reduction.
Figure 4:
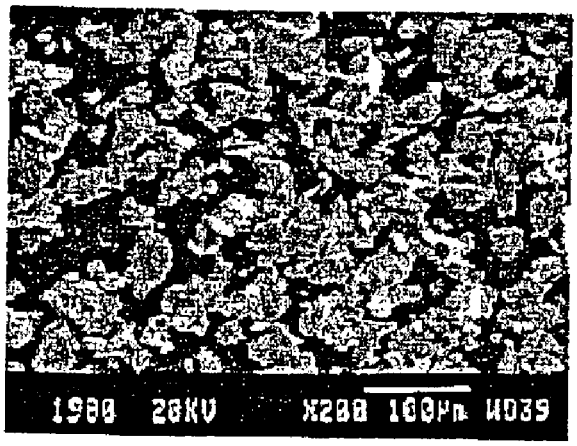
FIG. 4 shows the second water atomized intermetallic iron aluminide powder of FIG. 3 following wet milling.

FIG. 1 shows water atomized intermetallic iron aluminide powder having a particle size distribution shown in Table 1 prior to size reduction. FIG. 2 shows the same water atomized intermetallic iron aluminide powder following wet milling using acetone as the milling fluid. Table 2 shows the particle size distribution of the powder shown in FIG. 2 after milling. FIG. 3 shows a water atomized intermetallic iron aluminide powder having a particle size of less than 53 μm (−270 mesh) prior to size reduction. FIG. 4 shows the same water atomized intermetallic iron aluminide powder following wet milling using acetone as the milling fluid.

TABLE 1

| Mesh Size | Opening Size (μm) | Wt. % |
|---|---|---|
| +80 | 177 | 0 |
| +100 | 149 | 0.6 |
| +140 | 105 | 18.4 |
| +200 | 74 | 30.1 |
| +270 | 53 | 35.2 |
| +325 | 44 | 10.2 |
| −325 | −44 | 5.2 |

TABLE 2

| Mesh Size | Opening Size (μm) | Wt. % |
|---|---|---|
| +200 | 74 | 12.6 |
| +270 | 53 | 17.8 |
| +325 | 44 | 15.4 |
| +400 | 37 | 13.7 |
| +500 | 25 | 18.2 |
| +635 | 20 | 8.9 |
| −635 | 20 | 13.3 |

By comparing the shape and size of the water atomized intermetallic iron aluminide powder shown in FIGS. 1 and 2, and comparing the water atomized intermetallic iron aluminide powder shown in FIGS. 3 and 4, it can be seen that the wet milling process produced additional small particles. By reducing the size of larger particles, the powder usage yield can be improved because oversized particles are typically discarded as waste. Comparing the particle size distributions in Tables 1 and 2, it can also be seen that the wet milling process with acetone produced a relatively flat particle size distribution and increased the percentage of particles with a size of less than 53 μm (−270 mesh) from about 15% for the powder shown in FIG. 1 to about 70% for the powder shown in FIG. 2. Although the particle shape remained irregular, visible particle rounding occurred.

By decreasing the particle size and making the particle shape more rounded, the modified water atomized intermetallic aluminide powders can provide improved packing characteristics and improved sintering performance. Articles manufactured from the modified powders can provide improved mechanical properties.

As stated above, milling processes affect the oxygen content of water atomized iron aluminide powders. The oxygen content of the water atomized intermetallic iron aluminide powder shown in FIG. 1 was 0.388 wt. %, while the oxygen content of the powder shown in FIG. 2 was increased to 0.504 wt. % by wet milling.

For further comparison, water atomized intermetallic iron aluminide powder was subjected to wet milling using water as the medium. The oxygen content of the powders was found to have increased by several percent.

Figure 5:
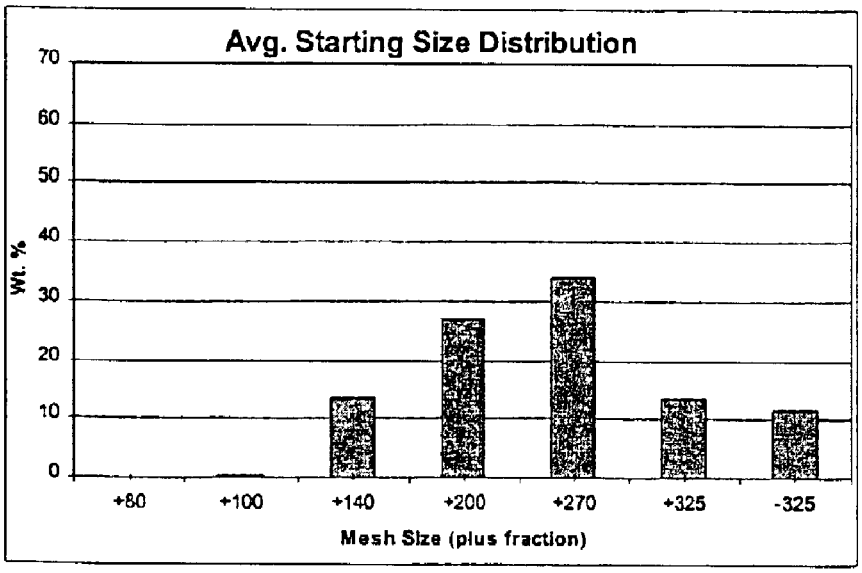
FIG. 5 shows a plot of the particle size distribution of a third water atomized intermetallic iron aluminide powder prior to size reduction.
Figure 6:
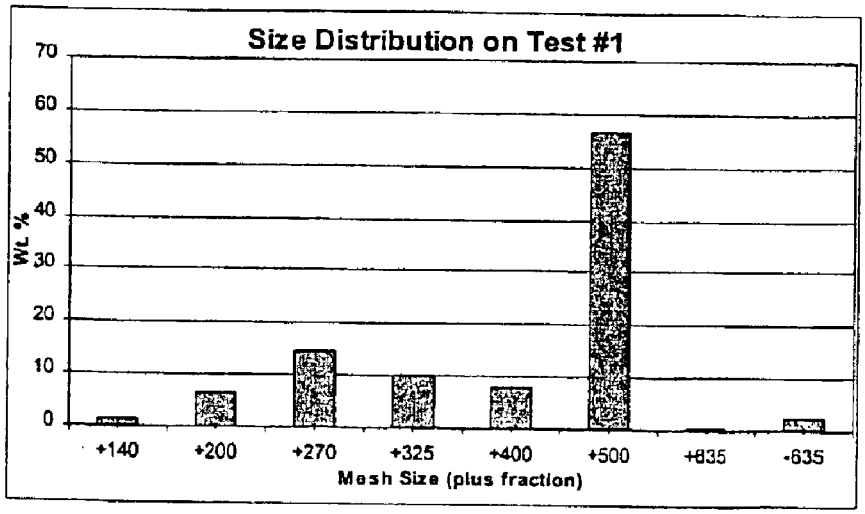
FIG. 6 shows a plot of the particle size distribution of the third water atomized intermetallic iron aluminide powder following dry milling.

For comparative purposes, water atomized intermetallic iron aluminide powder was subjected to a dry milling process. The size distribution of the powder before milling is shown in FIG. 5, while the size distribution resulting from the dry milling is shown in FIG. 6. As reflected in the size distributions shown in FIGS. 5 and 6, the dry milling process produced a large increase in the fraction of +500 mesh powder. Dry milling processes are preferable if a narrow size particle distribution is desired. The oxygen content of the powder increased from about 0.32 wt. % to about 0.658 wt. % as a result of the dry milling.

Figure 7:
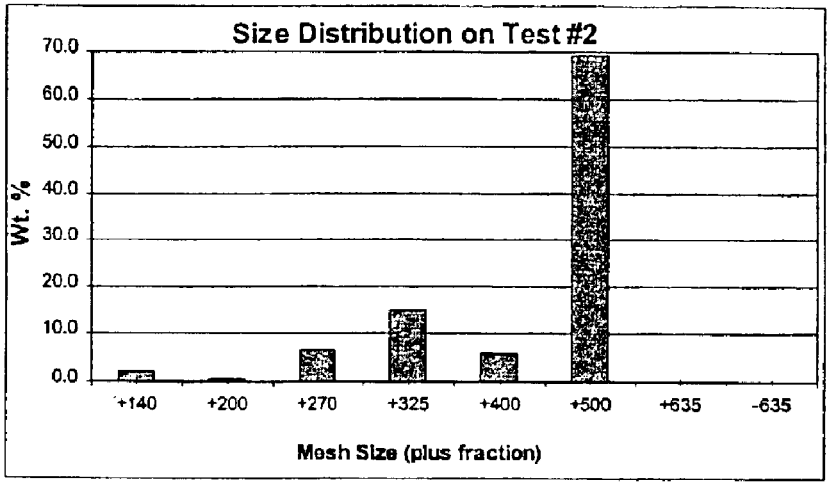
FIG. 7 shows a plot of the particle size distribution of the third water atomized intermetallic iron aluminide powder following dry milling.

Another dry milling process was conducted utilizing the same water atomized intermetallic iron aluminide powder. The size distribution resulting from the second dry milling process is shown in FIG. 7. The oxygen content of the powder increased from about 0.32 wt. % to about 1.03 wt. % as a result of the milling.

Accordingly, the above-described test results demonstrate that both wet and dry milling processes can be used to selectively reduce the particle size and change the particle shape of water atomized intermetallic aluminide powders.

Milling processes can also modify the oxygen content and/or oxide distribution of water atomized intermetallic aluminide powders. Oxides can be broken up and redistributed by milling to produce a more uniform distribution of oxides. By altering and redistributing the oxides in the powders, the sintering performance of the modified powders can be improved, i.e., particle bonding can be increased, as compared to non-milled powders, in which surface oxides reduce particle bonding during sintering.

Production of Articles

Methods of making intermetallic aluminide articles, which combine gas atomized intermetallic aluminide powders and water atomized intermetallic aluminide powders to produce powder blends or mixtures of the powders, and making articles from the powder blends or mixtures by metallurgical techniques, are also provided. In an embodiment, the water atomized intermetallic aluminide powders used to form the powder blends or mixtures have preferably been milled, as described above, to change their particle shape, particle size, and/or oxide distribution. However, in another embodiment, the water atomized intermetallic aluminide powders used to form a powder blend or mixture can be powders that have not been subjected to milling.

The gas atomized intermetallic aluminide powders that are used to form the powder blends or mixtures, and then to form articles from the powder blends or mixtures, can be powders that have previously been modified, as described above, to increase their oxygen content. However, the gas atomized intermetallic aluminide powders that are used to form the powder blends or mixtures can be powders that have not been modified to increase their oxygen content prior to forming the mixtures. The gas atomized intermetallic aluminide powders can be modified to increase their oxygen and oxide content after they have been blended or mixed with the water atomized intermetallic aluminide powders to form powder mixtures. The milled or non-milled water atomized intermetallic aluminide powders and the unmodified gas atomized intermetallic aluminide powders can be placed in an oxygen-containing atmosphere, which increases the oxygen content of the gas atomized intermetallic aluminide powders to a desired content in a controllable manner. As a result, the oxygen content of the water atomized intermetallic aluminide powders can be increased in the oxygen-containing atmosphere. The oxygen content of articles produced from the powder blends and mixtures can typically be controlled to be from about 0.10 wt. % to about 1.0 wt. %. However, any desired oxygen content can also be achieved.

The grain size of articles produced from the powder blends and mixtures is preferably less than about 25 μm, and more preferably less than about 15 μm. Reducing the grain size of the articles can improve the mechanical properties of the articles.

Powder blends or mixtures of the water atomized intermetallic aluminide powders and the gas atomized intermetallic aluminide powders can have any suitable ratio of the respective powders that provides desired characteristics to articles produced from the blends or mixtures. Preferably, water atomized intermetallic aluminide powders and gas atomized intermetallic aluminide powders are combined in a ratio of from about 4:1 to about 1:4.

Thus, articles can be produced from powder blends or mixtures of milled or non-milled water atomized intermetallic aluminide powders, and modified or un-modified gas atomized intermetallic aluminide powders, by different metallurgical processes. Particularly, articles can be produced by making green articles from the powder blends or mixtures, and then heating the green articles to a sufficiently high temperature and in suitable atmospheres to form sintered articles having desired compositions, shapes and sizes. For example, the articles can be sheets, bars and the like. These articles can be made in a continuous or non-continuous process.

Tape casting is a preferred process for forming articles from the powder blends or mixtures of milled or non-milled water atomized intermetallic aluminide powders, and modified or unmodified gas atomized intermetallic aluminide powders. Tape casting has been used for different applications, including the manufacture of ceramic products. See, e.g., U.S. Pat. Nos. 2,582,993; 2,966,719 and 3,097,929. Details of the tape casting process are described by Richard E. Mistler, Vol. 4 of the *Engineered Materials Handbook,* entitled "Ceramics and Glasses", 1991, and in an article by Richard E. Mistler entitled "Tape Casting: The Basic Process for Meeting the Needs of the Electronics Industry," in *Ceramic Bulletin,* Vol. 69, No. 6, 1990, the disclosures of which are hereby incorporated by reference in their entirety.

FIG. 8 shows a flow chart of processing steps of an embodiment of the tape casting processes. In the tape casting process, a blend or mixture of water atomized and gas atomized intermetallic aluminide powders is processed into an article by the illustrated process steps. The blends can comprise a total of two or more water and gas intermetallic aluminide powders (e.g. one water atomized and one gas atomized intermetallic aluminide powder) of the same chemical composition. The intermetallic aluminide powders are preferably intermetallic iron aluminide powders. The mixtures can comprise two or more water and gas atomized intermetallic aluminide powders having different chemistries. For example, the powders can include a total of two or more intermetallic iron aluminide powders having the same or different chemical compositions from each other. As described above, the powder blends and mixtures can have various ratios of the components. The powder blends or mixtures are sized, typically by sieving, to provide a desired size distribution of the powder particles.

The sieved powder is typically blended with an organic binder and solvent to produce a slip. The binder-solvent selection can be based on various factors. For instance, it is desirable for the binder to form a tough, flexible film when present in low concentrations. Further, the binder should volatilize and minimize residue. With respect to storage, it is desirable for the binder to not be adversely affected by ambient conditions. Moreover, for process economy it is desirable that the binder be relatively inexpensive and that the binder be soluble in an inexpensive, volatile, non-flammable solvent in the case of organic solvents. The choice of binder may also depend on the desired thickness of the tape, the casting surface on which the tape is deposited and the desired solvent.

Tape casting additives can include the following non-aqueous and aqueous additives. Suitable non-aqueous solvents include, but are not limited to, acetone, ethyl alcohol, benzene, bromochloromethane, butanol, diacetone, isopropanol, methyl isobutyl ketone, toluene, trichloroethylene, xylene, tetrachloroethylene, methanol, cyclohexanone, and methyl ethyl ketone (MEK). Suitable non-aqueous binders can include, but are not limited to, cellulose acetate-butyrate, nitrocellulose, petroleum resins, polyethylene, polyacrylate esters, poly methyl-methacrylate, polyvinyl alcohol, polyvinyl butyral, polyvinyl chloride, vinyl chloride-acetate, ethyl cellulose, polytetrafluoroethylene, and poly-α-methyl styrene. Suitable non-aqueous plasticizers include, but are not limited to, butyl benzyl phthalate, butyl stearate, dibutyl phthalate, dimethyl phthalate, methyl abietate, mixed phthalate esters, polyethylene glycol, polyalkylene glycol, triethylene glycol hexoate, tricresyl phosphate, dioctyl phthalate, and dipropylglycol dibenzoate. Suitable deflocculants/wetting agents include, but are not limited to, fatty acids, glyceryl trioleate, fish oil, synthetic surfactants, benzene sulfonic acid, oil-soluble sulfonates, alkylaryl polyether alcohols, ethyl ether of polyethylene glycol, ethyl phenyl glycol, polyoxyethylene acetate, polyoxyethylene ester, alkyl ether of polyethylene glycol, oleic acid ethylene oxide adduct, sorbitan trioleate, phosphate esters and steric acid amide ethylene oxide adduct.

For aqueous additives where the solvent is water, suitable binders include, but are not limited to, acrylic polymer, acrylic polymer emulsion, ethylene oxide polymer, hydroxy ethyl cellulose, methyl cellulose, polyvinyl alcohol, tris isocyaminate, wax emulsions, acrylic copolymer latex, polyurethane, polyvinyl acetate dispersion. Suitable deflocculants/wetting agents include, but are not limited to, complex glassy phosphate, condensed arylsulfonic acid, neutral sodium salt, polyelectrolyte of the ammonium salt type, non-ionic octyl phenoxyethanol, sodium salt of polycarboxylic acid, and polyoxyethylene onyl-phenol ether. Suitable plasticizers include, but are not limited to, butyl benzyl phthalate, di-butyl phthalate, ethyl toluene sulfonamides, glycerine, polyalkylene glycol, triethylene glycol, tri-N-butyl phosphate, and polypropylene glycol. Defoamers can be wax based and silicone based.

Typical binder-solvent-plasticizer systems for tape casting tapes having a thickness greater than about 0.010 inch can include 3.0% polyvinyl butyl as the binder (e.g., Butvar Type B-76 manufactured by Solutia Inc., Springfield, Mo.), 35.0% toluene as the solvent, and 5.6% polyethyleneglycol as the plasticizer. For a tape having a thickness of less than about 0.010 inch, the system can include 15.0% vinyl chlorideacetate as the binder (e.g., VYNS, 90-10 vinyl chloridevinyl acetate copolymer available from Union Carbide Corporation), 85.0% MEK as the solvent, and 1.0% butylphthalate as the plasticizer. In the foregoing compositions, the amounts are in parts by weight per 100 parts powder. The powder tape casting mixture can also include other additives as described above, such as deflocculants and/or wetting agents. Suitable binder, solvent, plasticizer, deflocculant and/or wetting agent compositions for tape casting processes will be apparent to those having ordinary skill in the art.

During the tape casting process, a layer of the powder blend or mixture is deposited onto a substrate, typically a sheet of material (such as a cellulose acetate sheet), as the sheet is being unwound from a roll or a continuous belt. The thickness of the powder layer on the sheet can be controlled by one or more doctor blades, which contact an upper surface of the powder layer as it travels on the sheet past the doctor blade(s).

The sheet is hot or cold rolled to a desired thickness, typically from about 0.02–0.04 inch. The rolled sheet is heated at a suitable heating rate to a temperature sufficient to drive off volatile components of the binder in the powder blend or mixture. The sheet can be heat treated in a continuous manner by passing the sheet through a furnace, or the sheet can be cut into sections, which are loaded into a furnace. For example, the rolled sheet can be heated at a heating rate of less than about 200° C./min to a temperature of from about 500–600° C. and held at this temperature in a vacuum or inert gas atmosphere for from about 0.5–3 hours to drive off the volatile components of the binder. Subsequently, the temperature of the sheet is increased to a sufficient temperature to sinter the sheet. Typically, the sintering temperature is from about 1200 to 1300° C. and the sintering time is from about 0.5–2 hours. A vacuum, inert gas or hydrogen atmosphere is typically used for sintering. The sintering typically results in a sheet porosity of from about 25 to 40%. In order to reduce the porosity, i.e., densify the sheet, the sintered article is hot or cold rolled to a desired thickness. For example, the sintered sheet can be cold rolled to a thickness of about 0.012 inch, annealed at 1000–1200° C. for about 0.5–2 hours in a vacuum or argon atmosphere, cold rolled to about 0.010 inch in one or more steps with intermediate annealing at 1000–1200° C. for about 0.5–2 hours, cold rolled to about 0.008 inch and again annealed at about 1100–1200° C. for about 0.5–2 hours in a vacuum or argon atmosphere. The sheet can then be processed further such as by trimming and stress relieving, and then be formed into a finished article. Tape casting can provide articles of the intermetallic aluminide powders in sheet form having selected compositions and dimensions.

In embodiments wherein the cast green tape is not directly further processed, the cast green tape can be coiled into a roll, and then stored until the roll is to be sintered and further processed into a finished article.

A preferred method includes steps of modifying the oxygen content, oxygen distribution, particle size and/or particle shape of gas atomized and/or water atomized intermetallic aluminide powders; and forming an article from a blend or mixture of the modified powders by a powder metallurgical technique. Preferred methods can advantageously utilize gas atomized powders in metallurgical techniques, such as tape casting, by mixing or blending the gas atomized powders with water atomized powders. Thus, process versatility can be improved by increasing powder selection, as well as articles can be produced with improved properties by utilizing desirable properties of both gas and water atomized powders.

Articles manufactured from the blends or mixtures of the modified water atomized and gas atomized intermetallic aluminide powders can have high sintered densities of preferably at least 90% of the theoretical density, and more preferably at least 98% of the theoretical density. Increasing the density of the articles (i.e., reducing the total porosity) provides improvements in the mechanical properties of articles formed from the powder blends or mixtures, including increasing strength and ductility.

Tests were conducted to confirm that the oxygen added by a milling process was distributed in the modified water atomized intermetallic aluminide powder in a well dispersed form. A green sheet was made using 100% water atomized intermetallic iron aluminide powder that had been wet milled using a solvent milling medium. The green sheet had an initial density of about 3.0 g/cm$^3$, which is lower than the initial density of about 3.6 g/cm$^3$ of green sheets for tape casting produced using powder mixtures of 80% gas atomized intermetallic iron aluminide powder (−270 mesh)/20% water atomized intermetallic iron aluminide powder (−400 mesh), which have not been subjected to the modifying methods described above. A green sheet produced using 100% milled water atomized intermetallic iron aluminide powder was processed in a batch furnace. The resulting properties of the articles are shown in Table 3, together with the properties of a roll compacted article formed from 100% water atomized (WA) intermetallic iron aluminide powder that had not been milled, and of a tape cast sheet formed from a blend of 80% gas atomized (GA) intermetallic iron aluminide powder/20% water atomized intermetallic iron aluminide powder that had not been modified.

TABLE 3

| Run | Roll Compaction | Tape Casting | Tape Casting |
|---|---|---|---|
| Powder | 100% WA | 80:20% GA/WA | 100% WA (milled) |
| $O_2$ (wt %) | 0.25 | 0.07 | 0.241 |
| C (wt %) | 0.14 | 0.14 | 0.326 |
| Yield Strength (ksi) | 40.9 | 39.6 | 43.1 |
| Ultimate Tensile (ksi) | 87.1 | 76.6 | 76.8 |
| Elongation (%) | 3.5 | 2.8 | 3 |
| Grain Size (ASTM) | 8.5 | 8 | 9.5 |
| Porosity Rating | 1 | 2 | 1 |

Figure 9:
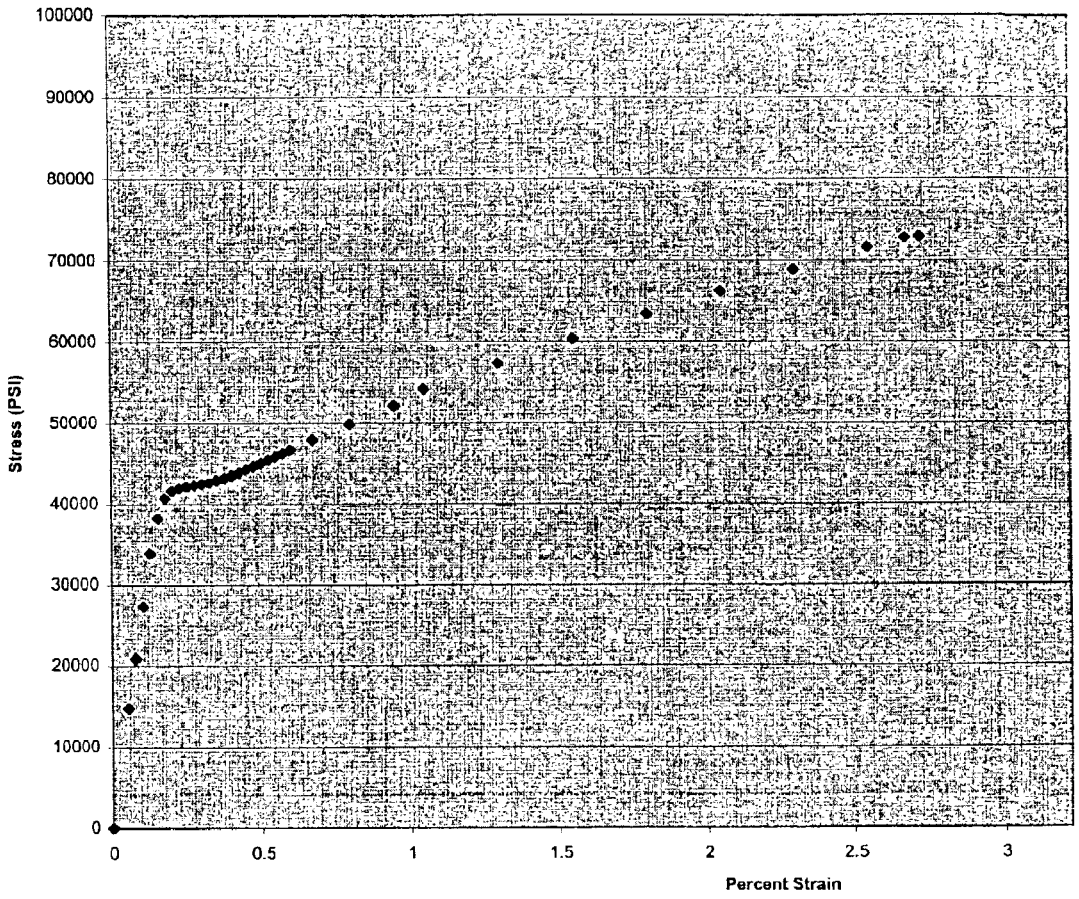
FIG. 9 is a stress/strain curve for a tape cast sheet formed from modified water atomized intermetallic iron aluminide powder.

FIG. 9 shows the stress/strain behavior of an article formed from the tape cast sheet made from 100% milled water atomized intermetallic iron aluminide powder. The curve exhibits a change in the work hardening rate after an initial few tenths of plastic strain, from a lower rate to a higher rate. This effect has not been observed by the inventors for normal roll compacted sheet. In addition, the 0.2% offset yield strength shown in FIG. 9 has been significantly increased as compared to values typically seen for tape cast strip (i.e., formed from powders that have not been modified), and is higher than normally observed in roll compacted strip (i.e., formed from water atomized powders that have not been modified). The average yield strength of the tape cast sheet formed from 100% milled water atomized powder was above 43 ksi. In addition, the grain size of this sheet was about ASTM 9.5 (13 $\mu$m) and the tape cast sheet exhibited a yield strength to tensile strength ratio of about 0.5, and an elongation of about 3%.

The above-described test results show that milling processes can favorably modify the distribution of oxides present in the water atomized intermetallic aluminide powders prior to milling, and also provide a favorable distribution of oxides produced during the milling by increasing the oxygen content of the powders. Consequently, the sintering behavior and mechanical properties of articles formed from the modified powders can be improved. In addition, the milling processes can reduce the grain size of articles produced from the modified powders, which can also contribute to improved mechanical properties.

Although the present invention has been described in connection with exemplary embodiments thereof, it will be appreciated by those skilled in the art that additions, deletions, modifications, and substitutions not specifically described may be made without departing from the spirit and scope of the invention as defined in the appended claims.

What is claimed is:

1. A method of making an intermetallic aluminide article having a controlled oxide content by a powder metallurgical technique, comprising:

modifying at least one of the particle size, particle shape, oxygen content and oxygen distribution of a water atomized intermetallic aluminide powder to form a first modified powder;

combining the first modified powder and a gas atomized intermetallic aluminide powder to form a powder mixture; and processing the powder mixture into an article by a powder metallurgical technique.

2. The method of claim 1, wherein the water atomized intermetallic aluminide powder is modified by milling to reduce the average particle size, change the particle shape and/or increase the uniformity of distribution of oxides in the water atomized powder.

3. The method of claim 2, wherein the milling is wet milling or dry milling.

4. The method of claim 1, further comprising increasing the oxygen content of the gas atomized intermetallic aluminide powder to form a second modified powder prior to the combining.

5. The method of claim 4, wherein the gas atomized intermetallic aluminide powder is modified by oxidation in an oxygen-containing atmosphere.

6. The method of claim 1, further comprising increasing the oxygen content of the gas atomized intermetallic aluminide powder to form a second modified powder during the heating.

7. The method of claim 1, further comprising sintering the article in an oxygen-containing atmosphere or in an inert atmosphere.

8. The method of claim 7, wherein the article has (i) an oxygen content of from about 0.10 wt. % to about 1.0 wt. % and/or (ii) an average grain size of less than about 25 $\mu$m after the sintering.

9. The method of claim 7, wherein the sintering is conducted in a continuous furnace or in a batch furnace.

10. The method of claim 1, further comprising:

increasing the oxygen content of the gas atomized intermetallic aluminide powder to form a second modified powder;

wherein the first modified powder and the second modified powder have an oxygen content effective to control an oxide distribution of the sintered article.

11. The method of claim 10, wherein:

the water atomized intermetallic aluminide powder is milled to reduce the average particle size and change the shape thereof; and the gas atomized intermetallic aluminide powder is oxidized to increase the oxygen content thereof during the heating.

12. The method of claim 10, wherein:

the water atomized intermetallic aluminide powder is milled to reduce the average particle size and change the shape thereof; and the gas atomized intermetallic aluminide powder is oxidized to increase the oxygen content thereof prior to the heating.

13. The method of claim 1, wherein the modified powder and the gas atomized intermetallic aluminide powder are combined in a ratio of from about 4:1 to about 1:4.

14. The method of claim 1, wherein the intermetallic aluminide is selected from the group consisting of Ni-based intermetallic aluminides, Ti-based intermetallic aluminides, and Fe-based intermetallic aluminides.

15. The method of claim 1, wherein the intermetallic aluminide is an iron aluminide alloy comprising from about 8 to about 32 wt. % Al.

16. The method of claim 1, wherein the powder metallurgical technique is tape casting and the article is a sheet.

17. The method of claim 1, wherein the article has a sintered density of at least about 90% theoretical density and optionally greater than about 98% theoretical density.

18. An intermetallic aluminide article formed by the method of claim 1.

19. A method of producing modified atomized intermetallic aluminide powder, comprising:

modifying at least one of the average particle size, particle shape, oxygen content and oxide distribution of a water atomized intermetallic aluminide powder to form a first modified powder;

modifying the oxygen content of a gas atomized intermetallic aluminide powder to form a second modified powder; and combining the first modified powder and the second modified powder to form an intermetallic aluminide powder blend or mixture.

20. A method of producing modified atomized intermetallic aluminide powder, comprising:

modifying a water atomized intermetallic aluminide to form first modified powder;

modifying the oxygen content of a gas atomized intermetallic aluminide powder to form a second modified powder; and combining the first modified powder and the second modified powder to form an intermetallic aluminide powder blend or mixture.

21. The method of claim 19, wherein the oxygen content of the gas atomized intermetallic aluminide powder is increased (i) prior to the combining and/or (ii) after the combining.

22. The method of claim 21, wherein the oxygen content of the gas atomized intermetallic aluminide powder is increased by heating the gas atomized intermetallic aluminide powder in an oxygen containing atmosphere.

23. The method of claim 19, wherein the water atomized intermetallic aluminide powder is modified by milling to decrease the particle size and change the shape of the water atomized intermetallic aluminide powder.

24. The method of producing modified atomized intermetallic aluminide powder, comprising:

modifying at least one of the average particle size, particle shape, oxygen content and oxide distribution of a water atomized intermetallic aluminide powder to form a first modified powder; and modifying the oxygen content of a gas atomized intermetallic aluminide powder to form a second modified powder;

wherein:

the water atomized intermetallic aluminide powder is milled to reduce the average particle size and change the particle shape thereof; and the gas atomized intermetallic aluminide powder is oxidized to increase the oxygen content thereof.

25. The method of claim 19, wherein the intermetallic aluminide is selected from the group consisting of nickel aluminides, titanium aluminides, and iron aluminides.

26. The method of claim 25, wherein the intermetallic aluminide is an iron aluminide.

27. A method of making an intermetallic aluminide article having a controlled oxygen content by a powder metallurgical technique, comprising: processing a blend or mixture comprising a water atomized intermetallic aluminide powder and a gas atomized intermetallic aluminide powder and a binder into an article by a powder metallurgical technique; and heating the article in an oxygen-containing atmosphere to increase an oxygen content of the article and to remove the binder in the article.

28. The method of claim 27, wherein the oxygen-containing atmosphere has a dew point of no more than about +60.degree. F. and the heating is carried out in an atmospheric oven.

29. The method of claim 27, wherein the water atomized intermetallic aluminide powder is blended or mixed with the gas atomized intermetallic aluminide powder in a ratio from about 4:1 to about 1:4.

30. The method of claim 27, further comprising modifying at least one of the water atomized intermetallic aluminide atomized powder and the gas atomized intermetallic aluminide powder with respect to at least one of average particle size, particle shape, oxygen content and oxygen distribution.

31. The method of claim 27, wherein the powder metallurgical technique is tape casting and the article is a sheet.

32. The method of claim 28, wherein the intermetallic aluminide is selected from the group consisting of nickel aluminides, titanium aluminides, and iron aluminides.

33. The method of claim 32, wherein the intermetallic aluminide is an iron aluminide alloy.

34. The method of claim 27, further comprising, subsequent to the heating, sintering the article to achieve a final density of the article greater than about 90% theoretical density and optionally greater than about 98% theoretical density.

35. A method of making an intermetallic aluminide article having a controlled oxygen content by a powder metallurgical technique, comprising: modifying at least one of the average particle size, particle shape, oxygen content and oxygen distribution of a water atomized iron aluminide powder to form a first modified powder; modifying the oxygen content of a gas atomized iron aluminide powder to form a second modified powder; tape casting an article comprising a blend or mixture of the first modified powder and the second modified powder; and sintering the article.

36. The method of claim 35, wherein: the water atomized intermetallic aluminide powder is milled to reduce the average particle size and change the particle shape thereof; and the gas atomized intermetallic aluminide powder is oxidized to increase the oxygen content thereof.

37. The method of claim 35, wherein the oxygen content of the gas atomized intermetallic aluminide powder is (i) increased prior to forming the blend or mixture and/or (ii) increased after forming the mixture.

38. The method of claim 37, wherein the oxygen content of the gas atomized intermetallic aluminide powder is increased by heating the gas atomized intermetallic aluminide powder in an oxygen containing atmosphere.

39. The method of claim 35, wherein the water atomized intermetallic aluminide powder is modified by milling.

* * * * *